US006516979B1

(12) United States Patent
Migliorini

(10) Patent No.: US 6,516,979 B1
(45) Date of Patent: Feb. 11, 2003

(54) METHOD AND APPARATUS FOR HANDLING TEXTILE ARTICLES, ESPECIALLY FOR LOADING ARTICLES ON HOSIERY MACHINES

(75) Inventor: Pier Lorenzo Migliorini, Arezzo (IT)

(73) Assignee: Matec S.p.A. (IT)

( * ) Notice: Subject to any disclaimer, the term of this patent is extended or adjusted under 35 U.S.C. 154(b) by 220 days.

(21) Appl. No.: 09/712,079

(22) Filed: Nov. 14, 2000

Related U.S. Application Data

(62) Division of application No. 09/320,311, filed on May 26, 1999, now Pat. No. 6,276,577.

(30) Foreign Application Priority Data

May 27, 1998 (IT) ..... FI98A126

(51) Int. Cl.[7] ..... A47G 25/90
(52) U.S. Cl. ..... 223/75; 223/112; 223/1
(58) Field of Search ..... 223/112, 75–111, 223/77, 52

(56) References Cited

U.S. PATENT DOCUMENTS 4,539,924 A 9/1985 Bell, Jr. et al.
4,881,477 A 11/1989 Gazzarini

FOREIGN PATENT DOCUMENTS

| | | |
|---|---|---|
| EP | 0 306 460 A | 3/1989 |
| EP | 0 508 014 B1 | 10/1992 |
| EP | 0 508 014 | 10/1992 |
| EP | 0 521 206 A1 | 1/1993 |
| GB | 2 103 257 | 2/1983 |

*Primary Examiner*—Bibhu Mohanty
(74) *Attorney, Agent, or Firm*—McGlew and Tuttle, P.C.

(57) ABSTRACT

Apparatus for handling textile articles, comprising means to engage a portion (30) of same articles in a station for the removal thereof and to operate the handling thereof in a predetermined direction (F) up to a station for either the unloading or the release thereof, characterized in that it comprises means (6), acting between said removal and handling means and said article portion (30) engaged by the latter, in order to move said article portion forward by rotating it in said direction (F) about a respective fold axis (u—u): said means (6) being in an active condition in correspondence of the unloading of the articles (3) and, respectively, in a rest condition in correspondence of the removal and handling thereof.

3 Claims, 10 Drawing Sheets

METHOD AND APPARATUS FOR HANDLING TEXTILE ARTICLES, ESPECIALLY FOR LOADING ARTICLES ON HOSIERY MACHINES

This is a Divisional of application Ser. No. 09/320,311 filed May 26, 1999 now U.S. Pat. No. 6,276,577, and the entire disclosure of this prior application is considered to be part of the disclosure of the accompanying application and is hereby incorporated by reference therein.

The present invention refers to a method and apparatus for handling textile articles, especially for loading articles on hosiery machines. One of the problem of greater concern in the processing of textile articles is the holding or gripping of the same articles during those steps stages which provide for their transfer between a plurality of work stations or within a same station.

For example, in the stocking-manufacturing sector, this problem relates, particularly, to the operations for turning the stockings inside-out on toe-seaming machines, so-called "toe-closers" and, more generally, to the automatic loading of stockings support members in assembly-line machines for the formation of pantyhose articles.

The devices known at present for the loading of hoses in toe-closer machines, provide for picking up the stockings being held in correspondence of their elastic hem and transferring them thus held onto said hoses wherein the toe of the articles is introduced to allow them to be turned inside-out afterwards. Following this operation, the article results most of the times with the portion of their elastic hem being folded up and this may imply that, after the seaming of the toe, the article is inaccurately removed from the toe-closer's hoses and incorrectly positioned onto the shapes of machines, such as the line-closers, during the successive assembly steps for the manufacturing of pantyhose articles.

U.S. Pat. No. 4,539,924, EP 521206 and EP 508014 documents disclose devices for the automatic loading of articles on toe-closers and on assembling machines for pantyhose formation.

The devices disclosed in the above documents, exhibit, substantially, a plurality of article-gripping members in correspondence of the elastic hem, said members being mounted on a support movable between a station for gripping the articles unloaded from a device which set them in a predetermined orientation, and a release station in correspondence of the machine receiving these articles.

These documents do not teach how to overcome the above mentioned drawback.

The main object of the present invention is to propose an apparatus allowing to optimize the processes implemented in the textile industry for handling articles to be displaced between a plurality of stations or between machines or devices of a same station.

This result has been achieved, according to the invention, by providing an apparatus and a method having the features indicated in the independent claims. Further characteristics being set forth in the dependent claims.

The present invention makes it possible to always ensure the most correct grip and handling of articles, such as stockings for example, which require to be suitably moved during the operations for their manufacturing.

An apparatus according to the invention is easy to make, cost-effective, reliable even after a prolonged service life, easily installable on existing stocking-feeding lines and able to operate in a fully automatic fashion.

These and other advantages and characteristics of the invention will be best understood by anyone skilled in the art from a reading of the following description in conjunction with the attached drawings given as a practical exemplification of the invention, but not to be considered in a limitative sense, wherein.

Figure 1A:
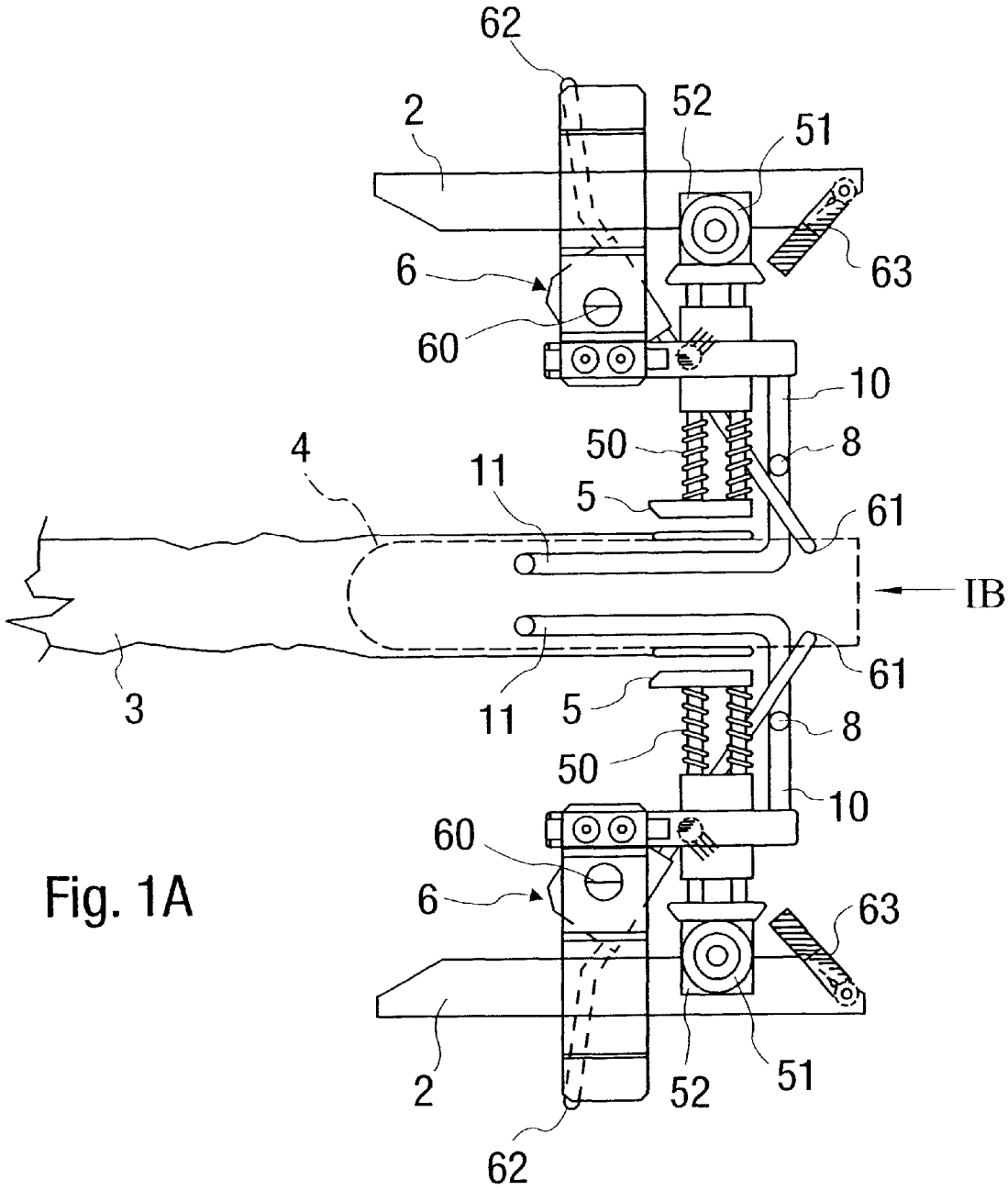
FIG. 1A is a schematic view in longitudinal section of an apparatus, according to the invention, as it picks up a stocking by the elastic hem of the latter.
Figure 1B:
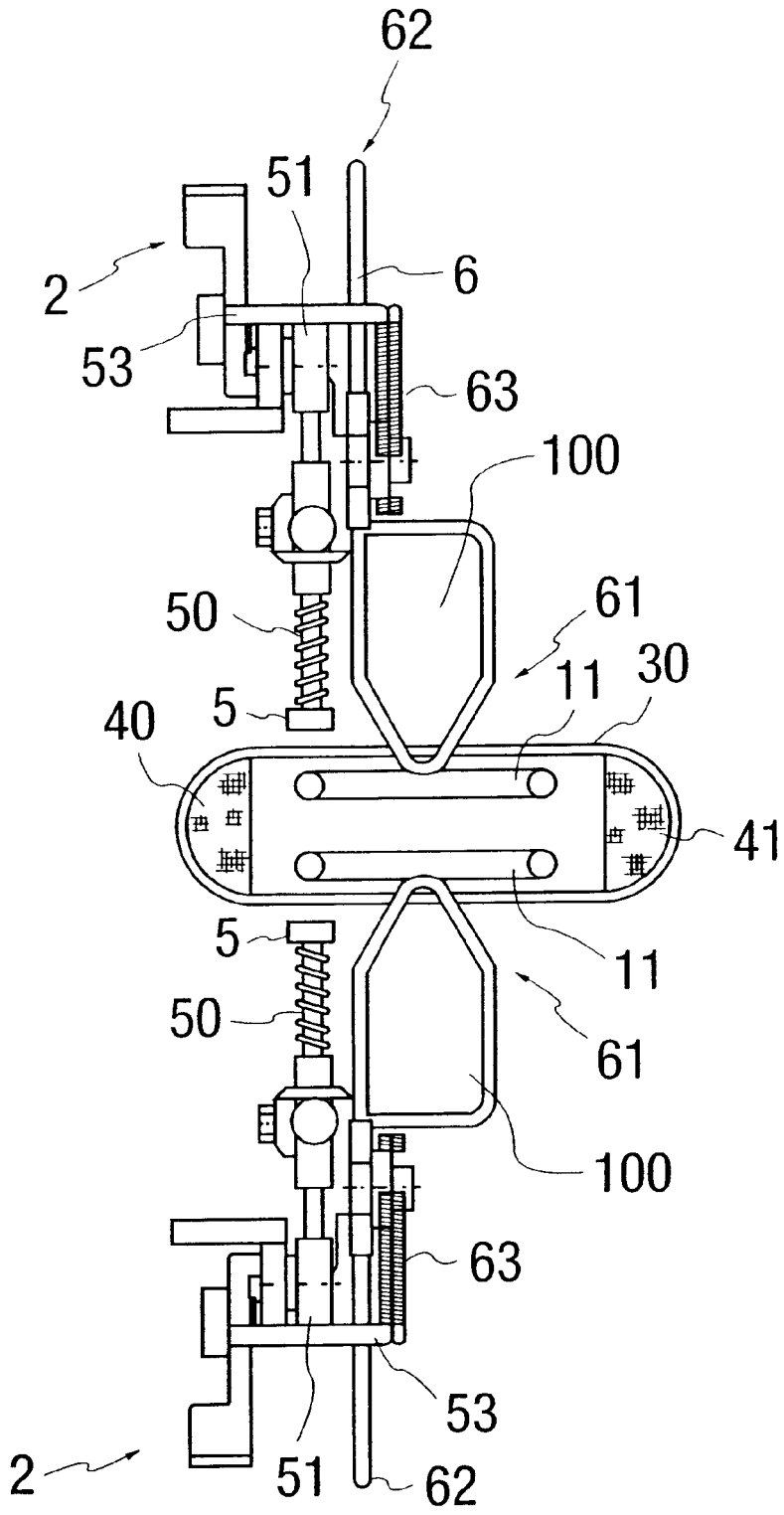
FIG. 1B is a view from "P" of the apparatus of FIG. 1A.
Figure 2A:
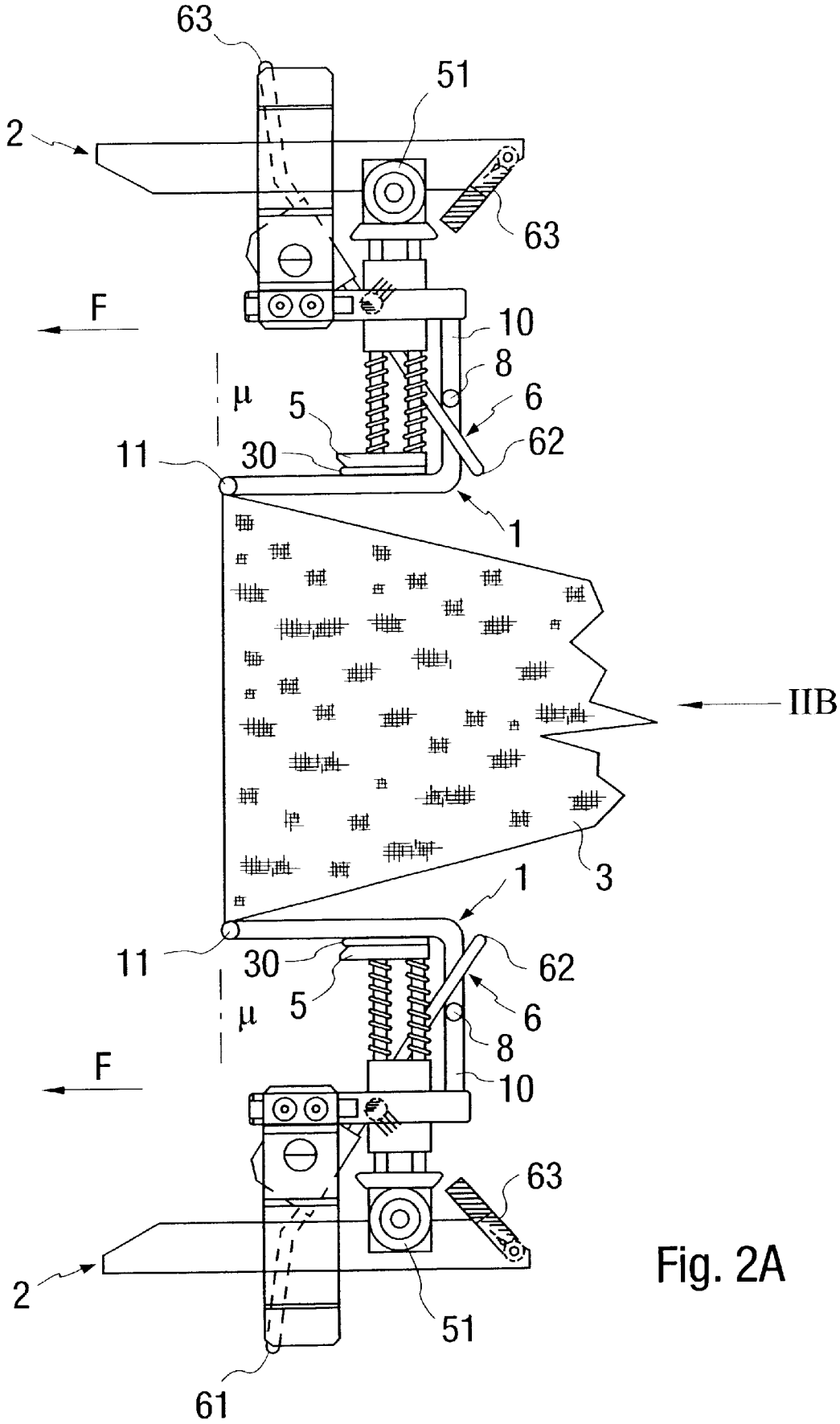
FIG. 2A is a view of the apparatus shown in the preceding figures as it moves the stocking in the direction of arrows "F"
Figure 2B:
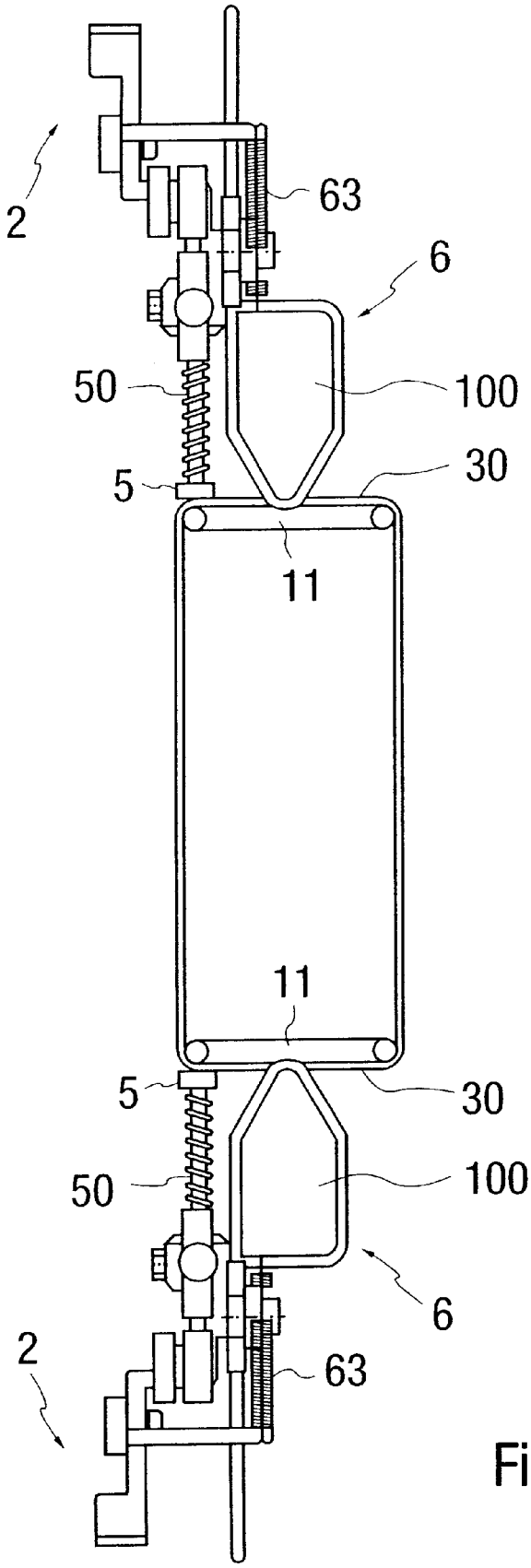
FIG. 2B is a view from "Q" of the apparatus of FIG. 2A.
Figure 3A:
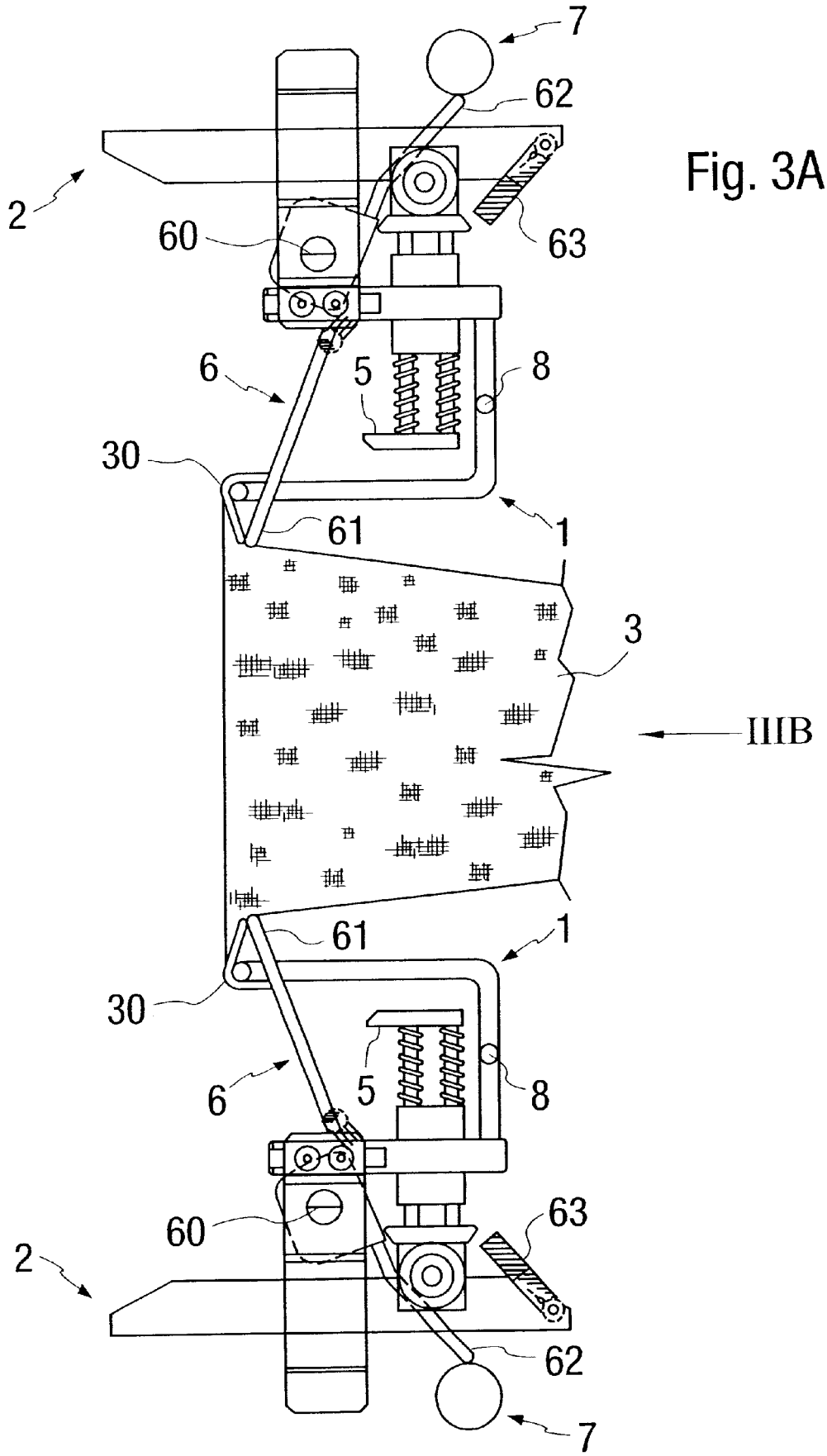
FIG. 3A shows the apparatus of the preceding figures as it releases or unloads the stocking.
Figure 3B:
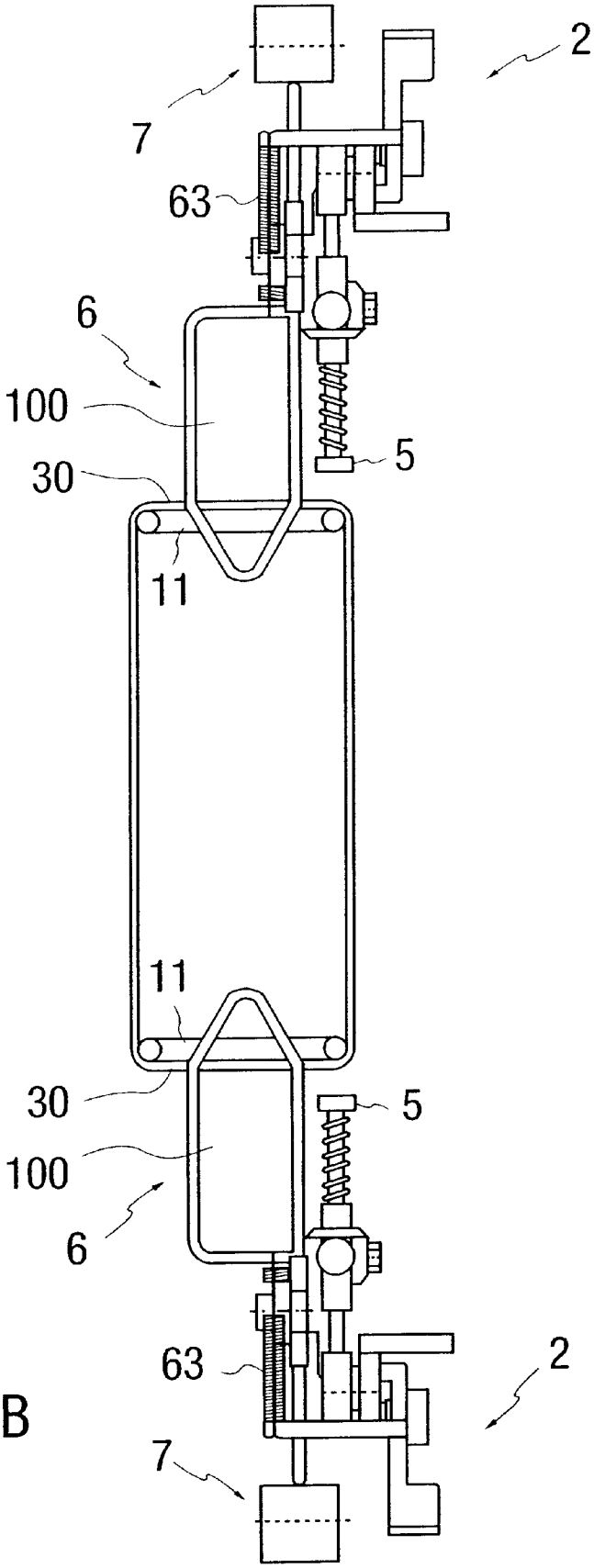
FIG. 3B is a view from "R" of the apparatus of FIG. 3A.
Figure 4A:
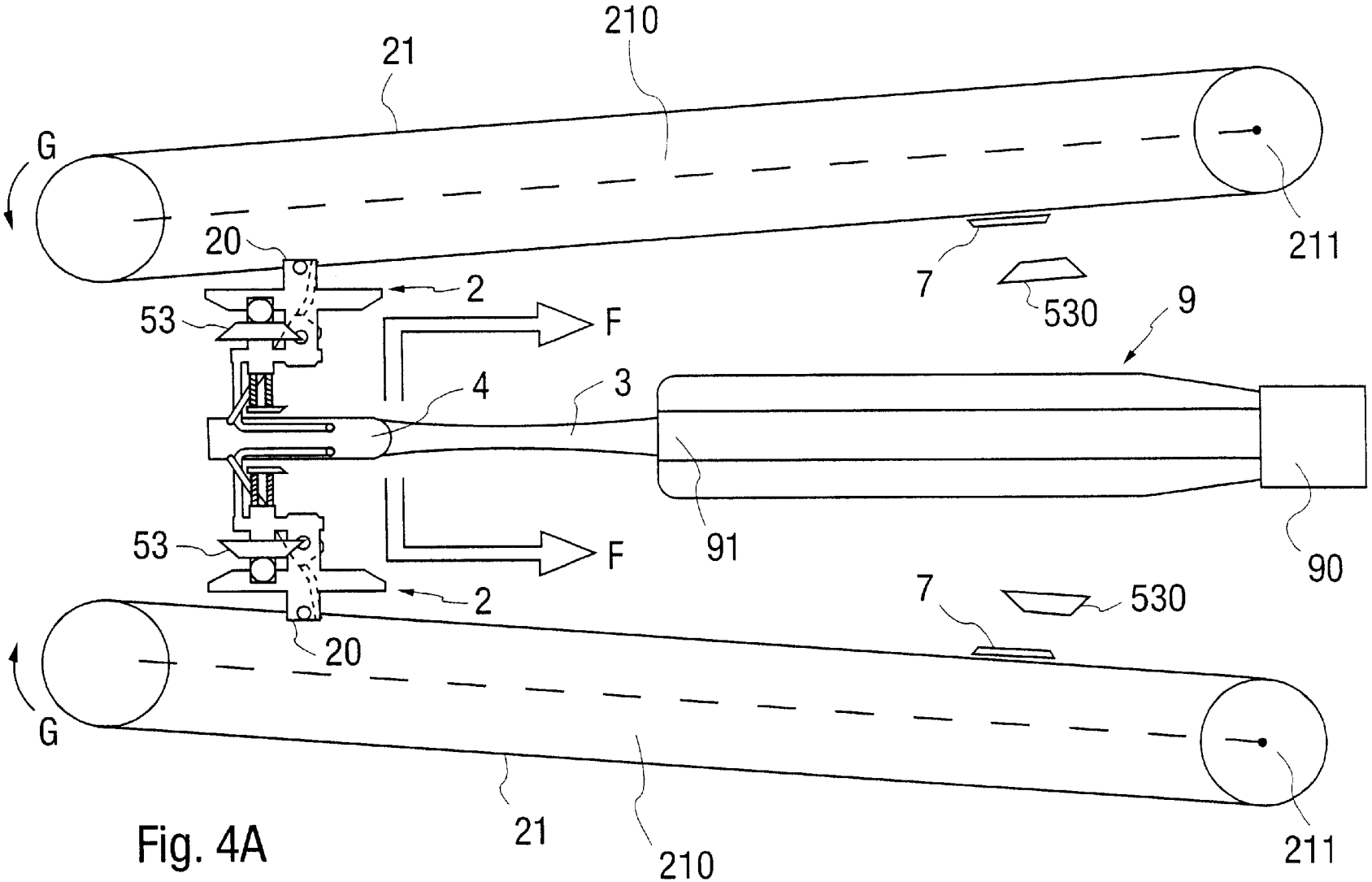
FIG. 4A is a general schematic representation of the apparatus, according to the invention, as view in the condition of FIG. 1A.
Figure 4B:
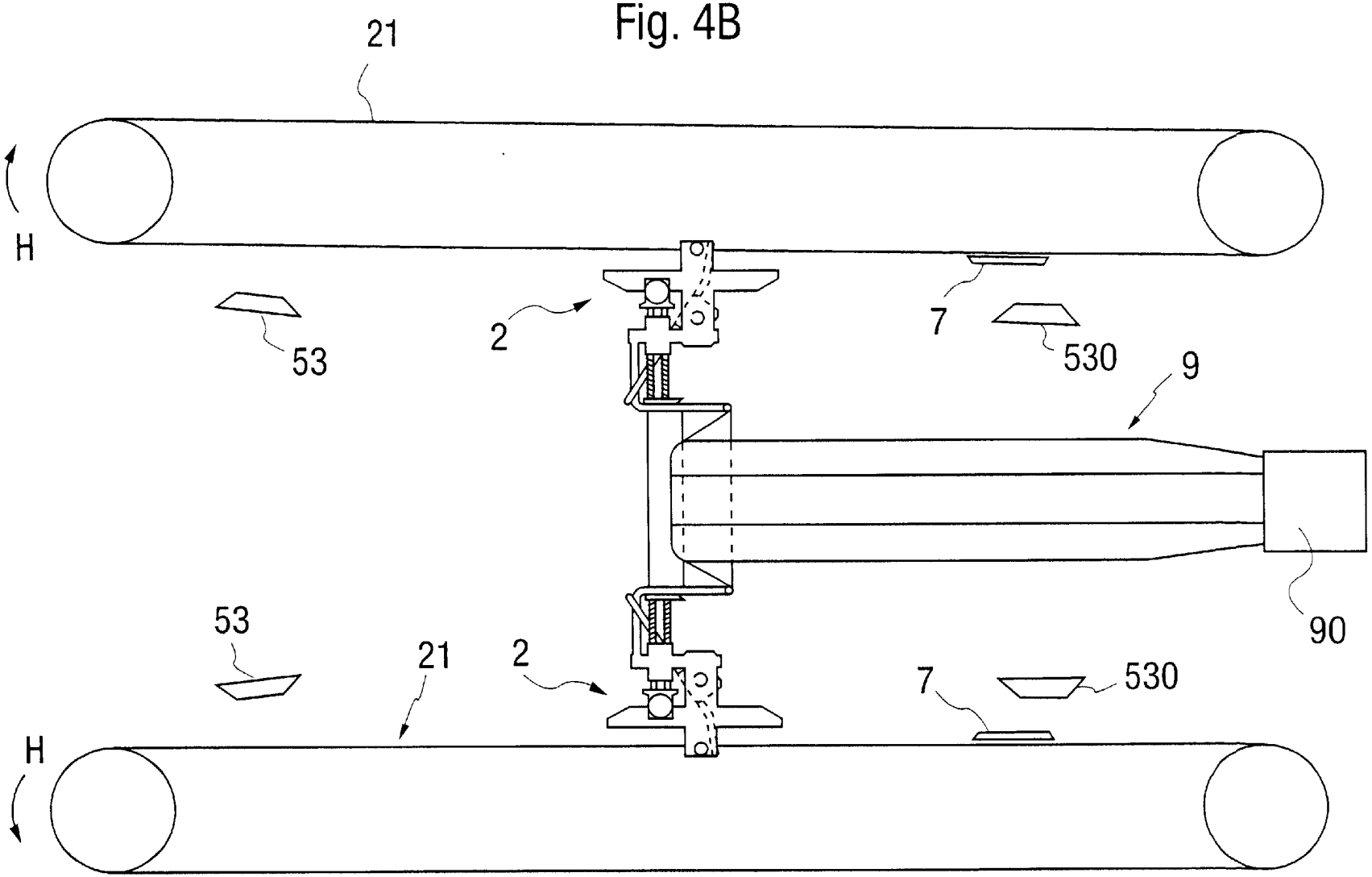
FIG. 4B is a view similar to that of FIG. 4A, with the apparatus in the condition of FIG. 2A.
Figure 4C:
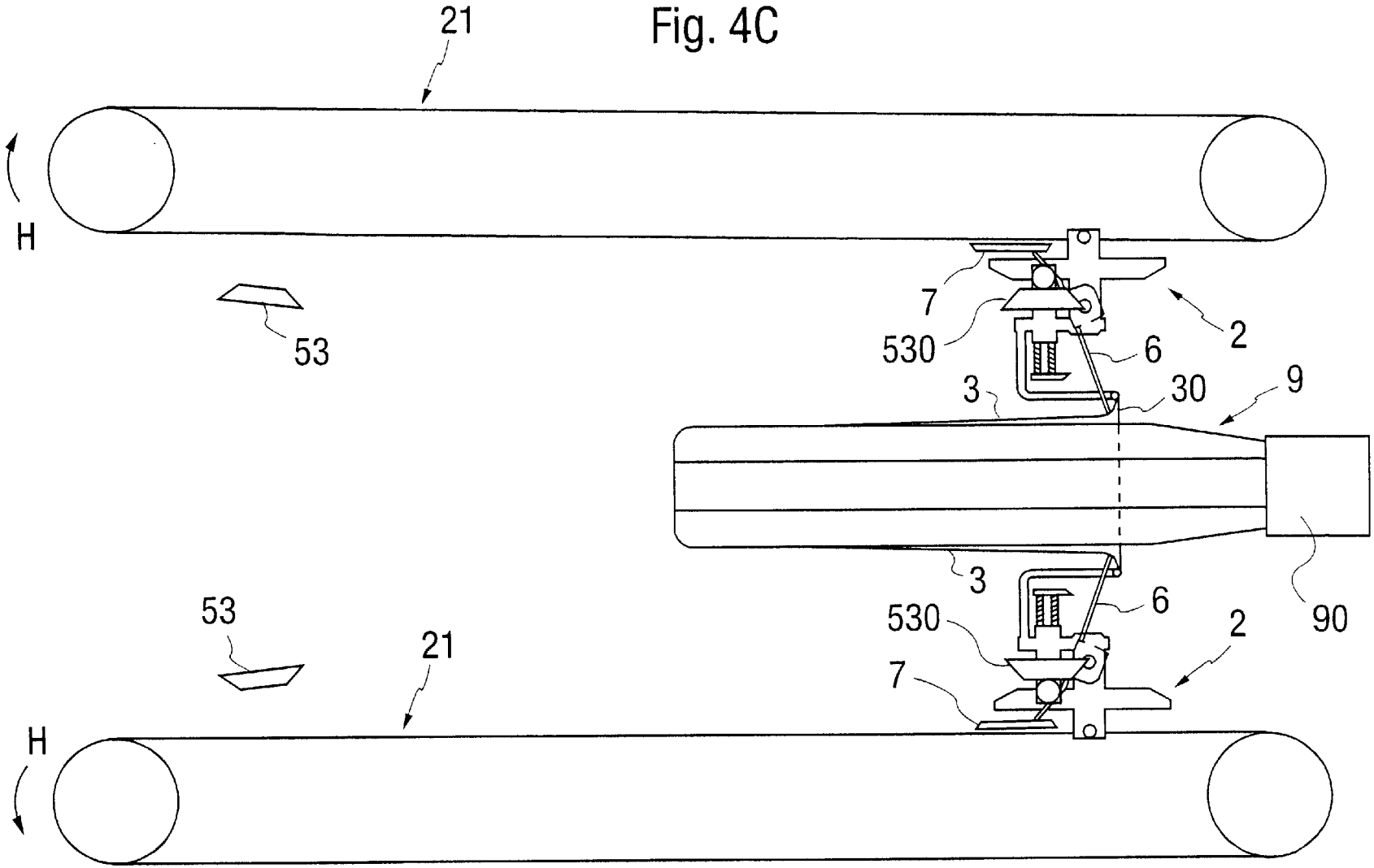
FIG. 4C is a view similar to that of FIG. 4A, with the apparatus in the process of releasing the stocking.
Figure 4D:
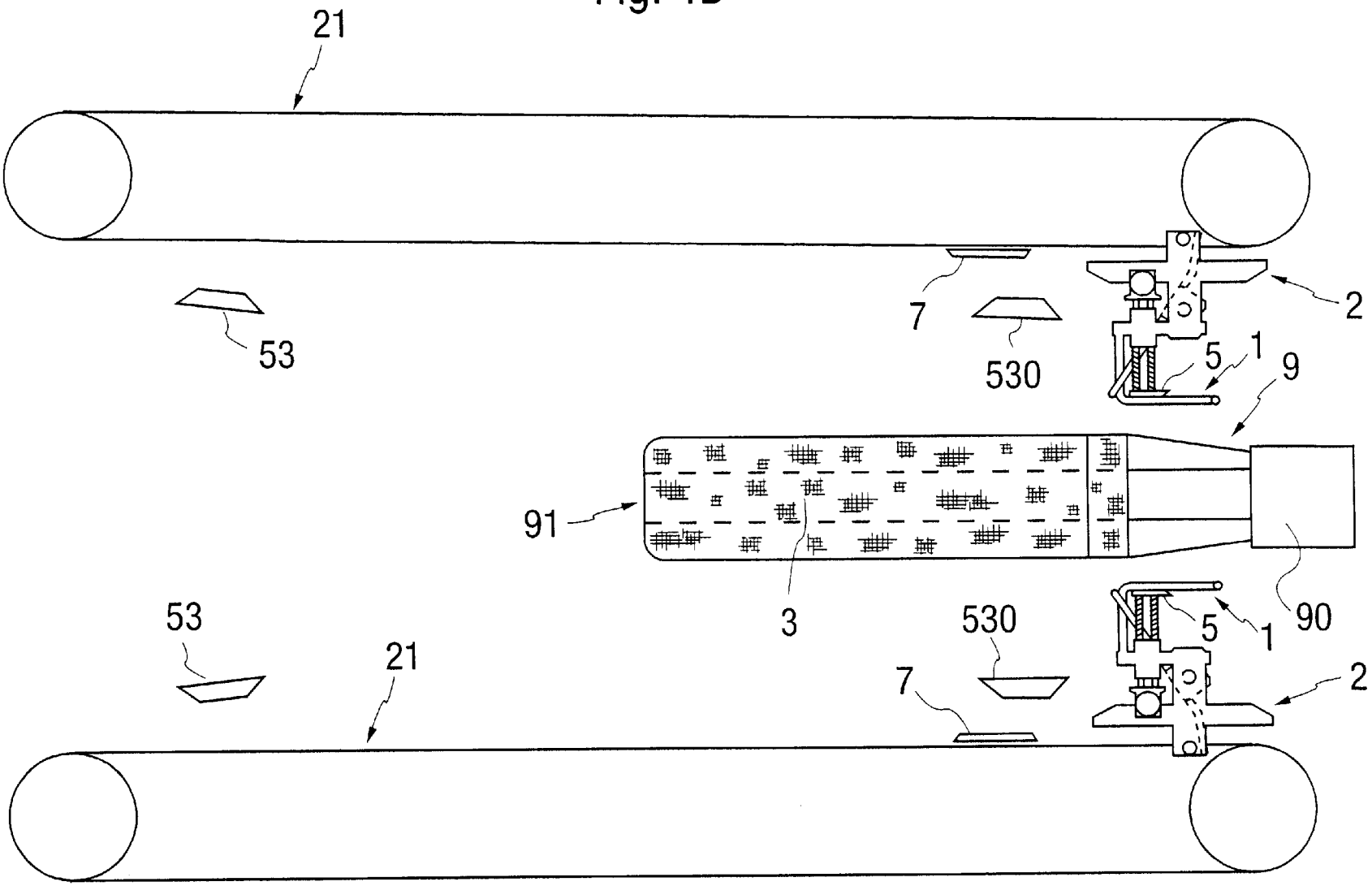
FIG. 4D is a view similar to that of FIG. 4A, with the apparatus having a configuration taken up after the step of FIG. 4C.

Reduced to its basic structure, and reference being made to the figures of the attached drawings, an apparatus according to the invention comprises at least two rigid elements (1) L-bent and opposite to each other, each of which has a substantially vertical (10) portion solid to a transport means (2) and a substantially horizontal portion (11), which is the extention of the first one (10), to be introduced into the stocking (3) under work through the elastic hem (30) of the latter. The elastic hem (30) of the stocking (3) may be stretched apart beforehand by means of a retractor (4) consisting of a segment able to be opened up in two parts (40, 41)—as illustrated in FIG. 1B—and on which the stocking's elastic hem is fitted in advance by pneumatic suction. The Italian Patent Application FI 97 A 135 discloses in more detail a retractor of this type. Said means (2) for transporting the elements (1) comprise—according to the example illustrated in the drawings—for each element (1), a plate with appendix (20) hinged to a loop-closed chain (21) which develops in a plane parallel to the direction (F) of motion of the stocking (3). Each of said elements (1), therefore, results associated to a corresponding carriage (2) movable in the direction (F) of motion of the stocking (3), so that the carriages (2) of opposite elements (1) will result, in turn, located on opposite sides of the stocking (3) to be treated—as illustrated in FIGS. 4D—4D. The two chains (21) extend throughout the area of motion of the stockings (3) to be treated and are mounted on relevant arms (210) angularly oscillating about respective axes (211) orthogonal to said direction (F) of motion of the stocking (3), to allow the carriages (2) to move to and from the retractor (4) within the area od engagement of the stocking (3)—as indicated by the arrows (G) and (H) in FIGS. 4A and 4B. The rotation of said arms (210) about the respective axes (211) is achieved by means of relevant actuators (not shown in the figures of the attached drawings). Associated to each carriage (2) is a presser (5) facing the horizontal portion (11) of the corresponding element (1), said presser (5) being associated to spring means (50) which act on the latter to keep it compressed on the elastic hem (30) of the article (3), that is, on the horizontal portion (11) of the respective element (1). In this way, the assembly (1, 5) of each carriage (2) makes up a normally closed gripper able to engage, that is, to compress and held said elastic hem (30) upon the removal and handling stage thereof, as well as to disengage it upon the release stage thereof. The command enabling the opening of each gripper (1, 5) is operated by sliding a roller (51), which is solid to the body (52) and positioned diametrally opposite to the latter, onto a fixed cam (53) located in correspondence of the retractor (4) and suitably shaped to achieve—with the carriages (2) being moved close to the retractor (4), as illustrated in FIG. 4A—the withdrawal of the presser (5) from the horizontal portion (11) of the respective element (1). The same command can be given upon the step for the release of the elastic hem (30) of the stocking (3), by means of a relevant cam (530) suitably located at the height [in front] of the station for the release of articles. Each of said carriages (2) carries also a body (6) mounted for angularly oscillating about an axis (60) orthogonal to the direction (F) of advancement of the stocking (3). The oscillation axis (60) of said body (6) is in correspondence of an appendix (21) of the relevant carriage (2). Said body (6) is associated to spring means (63), intended to counteract its oscillation about the said axis (60), and exhibits a front portion (61) facing the article (3) under treatment, and a rear portion (62) facing the opposite side. The front portion (61) of the body (6) is intended to engage, in order to push it forward, the elastic hem (30) of the stocking (3), upon the stage for unloading or releasing the latter—as explained in more details later on. The rear portion (62) of said body (6) is intended to interact with a fixed cam (7) in correspondence of the station for the unloading of the articles (as illustrated in FIGS. 3A and 4C) to drive them (61) into rotation about said axis (60) and thus move forward the front end (61) thereof. Said elastic means (63) acting on the body (6) ensure that the front portion (61) of the latter will result rotated forward and will engage the elastic hem (30) of the stocking (3) only in correspondence of the step for the release thereof. Provided on the vertical portion (10) of each of said elements (1) is a pin (8) limiting the backward stroke of body (6) resulting from the return action exerted by the spring means (63). Advantageously, according to the invention, the front portion (61) of said body (6) has a substantially pentagonal profile with a vertex facing the area of action of the relevant element (1).

Said body (6) may consist, as illustrated in the figures of the accompanying drawings, of a single, filiform element having a suitable profile.

The procedure according to the invention includes the following operating steps:

- picking up each stocking (3) to be treated by holding its elastic hem (30) with gripper means (1, 5);
- moving the stocking (3), with the elastich hem (30) thus engaged, in a predetermined (F) direction of advancement up to an unloading station in which the elastic hem (30) is disengaged from said gripper means (1, 5);
- engaging and pushing forward, in correspondence of said unloading station, said elastic hem so as to cause it—provided it is folded up, that is, bent about an axis (u—u)—to rotate about said axis (u—u) and move forward.

The operation of the above described apparatus is as follows.

The loading of the stocking (3) onto the segment (4) may be carried out either manually or automatically by a pneumatic feeder of known type which disposes the stocking with the portion of its elastic hem (30) facing forward and with the toe portion being aspirated into a hose (9) of a toe-closer machine (a part (90) of which supporting said hose can be seen in FIGS. 4A—4D) . Once the elastic hem (30) of the stocking (3) results fitted on the retractor (4), the latter is activated to cause it to be stretched apart. In this way, the elastic hem (30) of the stocking (3) results in a condition suitable for the insertion of the portions (11) of elements (1) therethrough. This insertion is operated by moving the carriages (2) close to the retractor (4), as illustrated in FIG. 4A, and by operating the relevant chains (21) so as to cause the translation of carriages (2) in the direction of arrows (F). Upon completion of this operation, during which the grippers (1, 5) are open, the arms (210) are rotated about the relevant axes (211) as indicated by the arrows (H) in FIG. 1B. Under this condition, the roller (51) of each buffer (5) does not interfere any longer with the respective cam (53), so that said elastic hem (30) will result compressed between the buffers (5) and the horizontal portions (11) of the two elements (10). The subsequent simultaneous translation of carriages (2), in the direction indicated by the arrows (F), implies the progressive turning inside-out of the stocking (3) on the hose (9), as the toe portion is retained within the suction mouth (91) of the hose (9). In correspondence of the station for the unloading of the stocking (3), the interaction between the rollers (51) of the two carriages (2) and relevant cams (530) causes the two gripper units (1, 5) to open again. Under this condition, the elastic hem (30) of stocking (3) will result free, and the forward rotation of the bodies (6) about the respective axes (60) will imply, owing to the forward thrust thus exerted on said hem (30) by the front portion (61) of same bodies (6), the corresponding forward rotation of the stocking's elastic hem (30) about the fold axis (u—u). In this way, there is achieved the final transfer of the stocking (3) to the hose (9) of the toe-closer, with the elastic hem (30) being in a perfectly stretched attitude. At this point, the hose (9) having the stocking loaded thereon with its elastic hem (30) thus stretched, is moved by the relevant driving means of the toe-closer machine, to a position suitable for the sewing of the toe or for further operations prior to performing said sewing, and its place is taken up by another hose to be loaded according to the above described procedures.

The cycle described above is performed without any interruption, however, if deemed necessary, it can be carried out in more separate stages in correspondence of one or more of which, the system is suitably stopped.

According to a further embodiment of the invention, said means (6) may be positioned in correspondence of the station for the unloading of articles (3), independently of carriages (2), in order to operate according to the previously indicated procedures, except for their being driven or activated by corresponding actuators provided at said unloading station.

It is understood that the method and apparatus of the present invention are applicable not only to the loading of hoses of a toe-closer machine for hosiery articles, but also to the loading of shapes of a pantyhose-sewing machine or "line-closer" and, more generally, to the removal, handling and unloading of textile articles of other type which are to be treated as to obtain the unloading thereof while their portion engaged by removal and handling means is in stretched condition.

Practically, all the construction details may vary in any equivalent way as far as the shape, dimensions, elements disposition, nature of the used materials are concerned, without nevertheless departing from the scope of the adopted solution idea and, thereby, remaining within the limits of the protection granted to the present patent for industrial invention.

I claim:

1. Method for handling textile articles comprising the operating steps of:

picking up each stocking to be treated by holding its elastic hem with gripper means;

moving the stocking, with the elastic hem thus engaged, in a predetermined direction of advancement up to an unloading station in which the elastic hem is disengaged from said gripper means;

engaging and pushing forward, in correspondence of said unloading station, said elastic hem so as to cause it—provided it is folded up, that is, bent about an axis—to rotate about said axis while moving forward.

2. The method according to claim 1, wherein said article is a stocking.

3. A method for handling a textile article with an elastic hem, the method comprising the steps of:

gripping the elastic hem of the article at a first station;

moving the article with the gripped elastic hem away from the first station and to a second station;

ungripping the elastic hem at said second station;

engaging and moving the elastic hem at said second station to rotate any folded portion of the hem about a fold axis of the folded portion.

* * * * *